US008983345B2

(12) United States Patent
Masui

(10) Patent No.: US 8,983,345 B2
(45) Date of Patent: Mar. 17, 2015

(54) DEVELOPER SUPPLYING MEMBER, DEVELOPING DEVICE, AND IMAGE FORMING APPARATUS

(71) Applicant: OKI Data Corporation, Tokyo (JP)

(72) Inventor: Naoki Masui, Tokyo (JP)

(73) Assignee: OKI Data Corporation, Tokyo (JP)

( * ) Notice: Subject to any disclaimer, the term of this patent is extended or adjusted under 35 U.S.C. 154(b) by 42 days.

(21) Appl. No.: 13/951,934

(22) Filed: Jul. 26, 2013

(65) Prior Publication Data

US 2014/0029987 A1 Jan. 30, 2014

(30) Foreign Application Priority Data

Jul. 26, 2012 (JP) ..... 2012-165544

(51) Int. Cl.
*G03G 15/08* (2006.01)

(52) U.S. Cl.
CPC ..... *G03G 15/0865* (2013.01); *G03G 15/0808* (2013.01)
USPC ..... 399/281; 399/286

(58) Field of Classification Search
USPC ..... 399/281, 286
See application file for complete search history.

(56) References Cited

U.S. PATENT DOCUMENTS

| | | | | |
|---|---|---|---|---|
| 5,768,668 | A * | 6/1998 | Shiraki et al. | 399/281 |
| 7,206,539 | B2 * | 4/2007 | Kawahara et al. | 399/281 |
| 7,979,010 | B2 * | 7/2011 | Fuwa et al. | 399/258 |
| 2006/0029436 | A1 * | 2/2006 | Toyoda et al. | 399/279 |
| 2006/0257175 | A1 * | 11/2006 | Endo et al. | 399/281 |
| 2011/0206421 | A1 * | 8/2011 | Masuyama et al. | 399/286 |
| 2012/0251188 | A1 * | 10/2012 | Matsuura | 399/265 |

FOREIGN PATENT DOCUMENTS

| | | | |
|---|---|---|---|
| JP | 09-080910 | A | 3/1997 |
| JP | 2001-134071 | A | 5/2001 |
| JP | 2002-108090 | A | 4/2002 |
| JP | 2002-236416 | A | 8/2002 |
| JP | 2004-317731 | A | 11/2004 |
| JP | 2010-128278 | A | 6/2010 |

* cited by examiner

*Primary Examiner* — G. M. Hyder
(74) *Attorney, Agent, or Firm* — Kubotera & Associates, LLC

(57) ABSTRACT

A developer supplying member is provided for supplying developer to a developer supporting member. The developer supplying member includes a foamed member having a discrete foam cell structure and being formed of a silicone rubber as a main component thereof. The foamed member constitutes a surface of the developer supplying member. The foamed member includes a foam cell wall dividing foam cells thereof and being exposed on the surface of the developer supplying member. The foam cell wall has a ten-point average surface roughness between 45.2 μm and 65.3 μm.

7 Claims, 7 Drawing Sheets

DEVELOPER SUPPLYING MEMBER, DEVELOPING DEVICE, AND IMAGE FORMING APPARATUS

BACKGROUND OF THE INVENTION AND RELATED ART STATEMENT

The present invention relates to a developer supplying member, a developing device, and an image forming apparatus.

Patent Reference has disclosed a conventional developing device to be disposed in an image forming apparatus of an electro-photography type. The conventional developing device includes a developing roller for supplying developer to a photosensitive member and a developer supplying roller for supplying developer to the developing roller.

Patent Reference Japanese Patent Publication No. 2002-108090

In the image forming apparatus of the electro-photography type having the conventional developing device, it is required to maintain good image quality for an extended period of time.

An object of the present invention is to provide a developer supplying member, a developing device, and an image forming apparatus capable of maintaining good image quality for an extended period of time.

Further objects and advantages of the invention will be apparent from the following description of the invention.

SUMMARY OF THE INVENTION

In order to attain the objects described above, according to a first aspect of the present invention, a developer supplying member is provided for supplying developer to a developer supporting member. The developer supplying member includes a foamed member having a discrete foam cell structure and being formed of a silicone rubber as a main component thereof. The foamed member constitutes a surface of the developer supplying member. The foamed member includes a foam cell wall dividing foam cells thereof and being exposed on the surface of the developer supplying member. The foam cell wall has a ten-point average surface roughness Rz between 45.2 μm and 65.3 μm.

According to a second aspect of the present invention, a developer supplying member is provided for supplying developer to a developer supporting member. The developer supplying member includes a foamed member having a discrete foam cell structure and being formed of a silicone rubber as a main component thereof. The foamed member constitutes a surface of the developer supplying member. The foamed member has a stress relaxation ratio between 23.7% and 30.8% upon being compressed.

According to the present invention, it is possible to provide the developer supplying member, the developing device, and the image forming apparatus capable of maintaining good image quality for an extended period of time.

DETAILED DESCRIPTION OF PREFERRED EMBODIMENTS

Hereunder, embodiments of the present invention will be explained with reference to the accompanying drawings. It should be noted that the present invention is not limited to the following description, and the embodiments can be modified within a scope of the present invention.

First Embodiment

Figure 1:
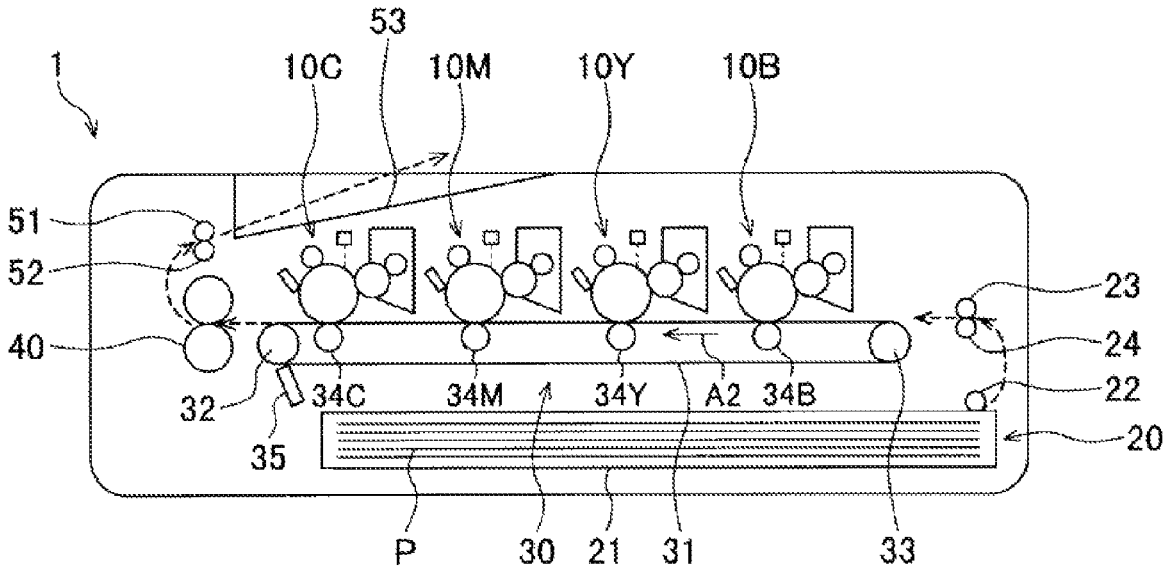
FIG. 1 is a schematic view showing an example of a configuration of an image forming apparatus according to a first embodiment of the present invention.

A first embodiment of the present invention will be explained. FIG. 1 is a schematic view showing an example of a configuration of an image forming apparatus 1 according to the first embodiment of the present invention. The image forming apparatus 1 is an apparatus for forming an image on a recording medium using an electro-photography process. In the first embodiment, the image forming apparatus 1 is a color printer for forming a color image using developer in four colors.

As shown in FIG. 1, the image forming apparatus 1 includes four image forming portions 10B, 10Y, 10M, and 10C for forming images in four colors of black (B), yellow (Y), magenta (M), and cyan (C), respectively. More specifically, the image forming portions 10B, 10Y, 10M, and 10C are configured to contain developer of black (B), yellow (Y), magenta (M), and cyan (C), so that the image forming portions 10B, 10Y, 10M, and 10C form developer images in four colors of black (B), yellow (Y), magenta (M), and cyan (C), respectively. Further, the image forming portions 10B, 10Y, 10M, and 10C are arranged in this order from an upstream side in a transportation direction of a recording medium P. The transportation direction of the recording medium P is represented with hidden line arrows in FIG. 1.

Figure 2:
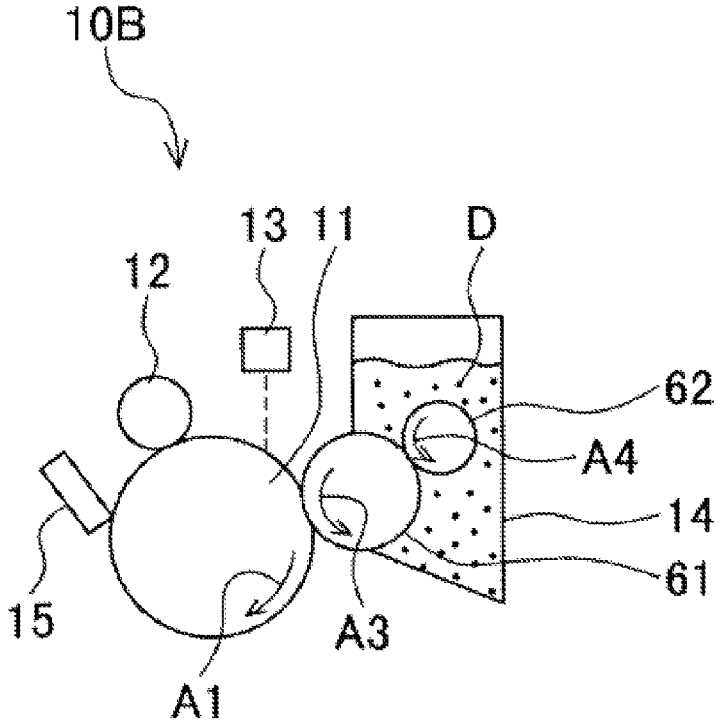
FIG. 2 is a schematic sectional view showing a configuration of an image forming portion of the image forming apparatus according to the first embodiment of the present invention.

FIG. 2 is a schematic sectional view showing a configuration of the image forming portion 10B of the image forming apparatus 1 according to the first embodiment of the present invention.

As shown in FIG. 2, the image forming portion 10B includes a photosensitive drum 11 as an image supporting member; a charging roller 12 as a charging device; an LED (Light Emitting Diode) head 13 as an exposure device; a developing device 14; and a cleaning blade 15 as a cleaning device.

In the embodiment, the photosensitive drum 11 is the image supporting member for supporting a static latent image, and is configured to rotate in a specific rotational direction (as represented with an arrow A1 in FIG. 2, a clockwise direction). Further, the photosensitive drum 11 has an outer diameter of about 30 mm. The charging roller 12 is configured to charge a surface of the photosensitive drum 11. The LED head 13 is configured to irradiate the surface of the photosensitive drum 11 thus charged according to image information, so that the static latent image is formed on the surface of the photosensitive drum 11. The developing device 14 is configured to develop the static latent image formed on the photosensitive drum 11 with developer (for example, toner), so that the developer image is formed on the photosensitive drum 11. The cleaning blade 15 is configured to remove developer remaining on the surface of the photosensitive drum 11 after transfer.

In the embodiment, similar to the image forming portion 10B, each of the image forming portions 10Y, 10M, and 10C includes the photosensitive drum 11, the charging roller 12, the LED (Light Emitting Diode) head 13, the developing device 14, and the cleaning blade 15.

In the embodiment, the image forming apparatus 1 further includes a sheet supply mechanism 20 for supplying the recording medium P (for example, a sheet) to the image forming portions 10B, 10Y, 10M, and 10C. The sheet supply mechanism 20 includes a sheet supply cassette 21 for retaining the recording medium P; a pickup roller 22 for picking up the recording medium P in the sheet supply cassette 21 one by one; and transportation rollers 23 and 24 for transporting the recording medium P thus picked up toward the image forming portions 10B, 10Y, 10M, and 10C.

In the embodiment, the image forming apparatus 1 further includes a transfer device 30 for transferring the developer images formed with the image forming portions 10Y, 10M, and 10C to the recording medium P. The transfer device 30 includes a transfer belt 31; a drive roller 32; a follower roller 33; transfer rollers 34B, 34Y, 34M, and 34C; and a cleaning blade 35.

In the embodiment, the transfer belt 31 is an endless member, and is arranged to extend with the drive roller 32 and the follower roller 33, so that the transfer belt 31 moves freely. Further, the transfer belt 31 is configured to support the recording medium P transported from the sheet supply mechanism 20. When the drive roller 32 rotates, the transfer belt 31 moves in a specific moving direction (represented with an arrow A2 in FIG. 2), so that the transfer belt 31 transports the recording medium P along the image forming portions 10Y, 10M, and 10C. The transfer rollers 34B, 34Y, 34M, and 34C are configured to transfer the developer images formed on the photosensitive drums 11 of the image forming portions 10B, 10Y, 10M, and 10C to the recording medium P, respectively. Further, the transfer rollers 34B, 34Y, 34M, and 34C are arranged to face the photosensitive drums 11 with the transfer belt 31 in between. The cleaning blade 35 is configured to remove developer remaining on the transfer belt 31.

In the embodiment, the image forming apparatus 1 further includes a fixing device 40 for fixing the developer images transferred to the recording medium P with the transfer device 30. Discharge rollers 51 and 52 are disposed on a downstream side of the fixing device 40 in the transportation direction of the recording medium P for discharging the recording medium P after the recording medium P passes through the fixing device 40. Further, a discharge portion 53 is disposed on the downstream side of the fixing device 40 in the transportation direction of the recording medium P for retaining the recording medium P thus discharged.

In the embodiment, the image forming apparatus 1 further includes a control unit (not shown); a drive sources such as a drive motor and the like (not shown); and a power source (not shown). The control unit is configured to control an operation of the image forming apparatus 1. The drive source is configured to supply a drive force to the photosensitive drums 11 and the various rollers according to an instruction of the control unit. The power source is configured to supply electric power to each component of the image forming apparatus 1 according to the instruction of the control unit. More specifically, the power source is configured to apply a specific voltage (a charging bias, a developing bias, and a supplying bias) to the charging roller 12, a developing roller 61, and a developer supplying roller 62.

Figure 3A:
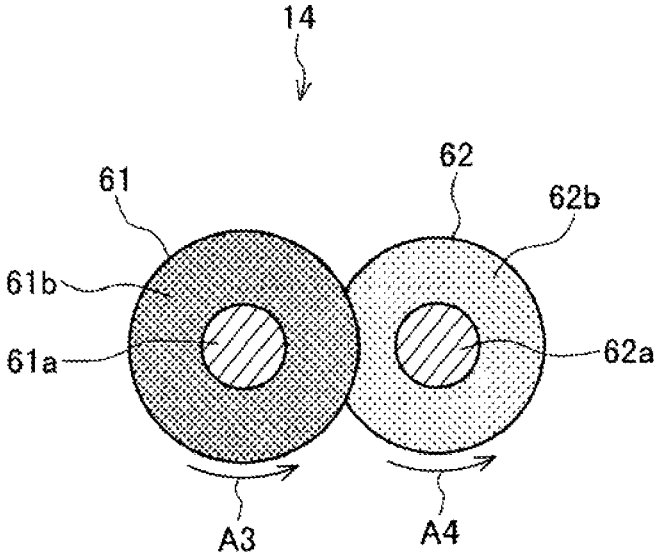
FIGS. 3(*a*) and 3(*b*) are schematic sectional views an internal configuration of a developing device of the image forming apparatus according to the first embodiment of the present invention, wherein FIG. 3(*a*) is a schematic sectional view showing a developing roller and a developer supplying roller of the developing device, and FIG. 3(*b*) is an enlarged sectional view showing an abutting portion between the developing roller and the developer supplying roller of the developing device.
Figure 3B:
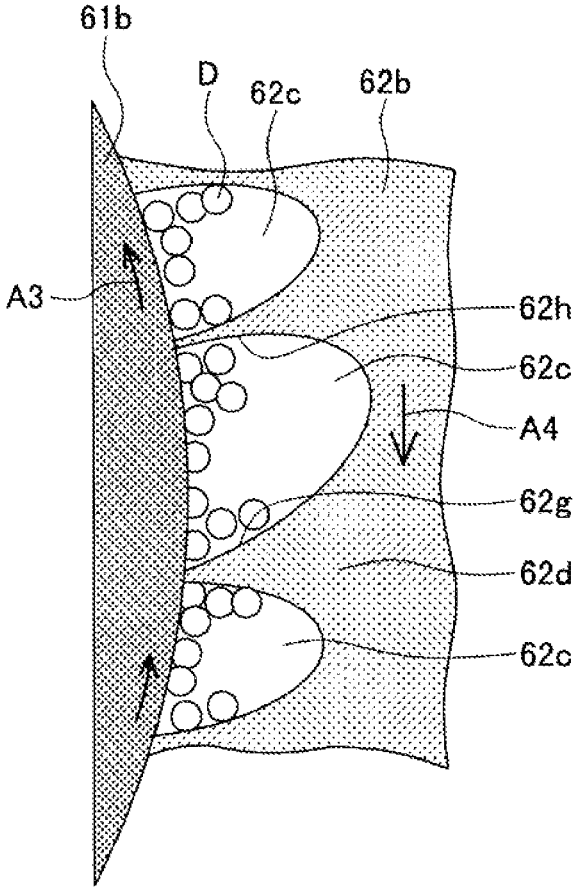

A configuration of the developing device 14 will be explained next in more detail with reference to FIGS. 2 and 3(*a*)-3(*b*). FIGS. 3(*a*) and 3(*b*) are schematic sectional views an internal configuration of the developing device 14 of the image forming apparatus 1 according to the first embodiment of the present invention. More specifically, FIG. 3(*a*) is a schematic sectional view showing the developing roller 61 and the developer supplying roller 62 of the developing device 14, and FIG. 3(*b*) is an enlarged sectional view showing an abutting portion between the developing roller 61 and the developer supplying roller 62 of the developing device 14.

As shown in FIGS. 2 and 3(*a*)-3(*b*), the developing device 14 is configured to retain the developer D. Further, the developing device 14 includes the developing roller 61 as a developer supporting member and the developer supplying roller 62 as a developer supplying member.

In the embodiment, the developing roller 61 is configured to supply the developer D to the static latent image on the photosensitive drum 11 to develop the static latent image, so that the developer image is formed on the photosensitive drum 11. The developing roller 61 is arranged to abut against the photosensitive drum 11, and rotates in a direction opposite to the photosensitive drum 11 (represented with an arrow A3, in a counterclockwise direction in FIGS. 2 and 3(*a*)).

In the embodiment, the developing roller 61 is formed in a cylindrical shape. Further, the developing roller 61 has an outer diameter of about 15.5 mm, and is configured to rotate at a circumferential speed of 239.8 mm/sec. As shown in FIG. 3(*a*), the developing roller 61 includes a metal shaft 61*a* as a conductive rotational axis and an elastic layer 61*b* formed on an outer circumference of the metal shaft 61*a*. The elastic layer 61*b* is formed of urethane as a main component thereof, and has an Asker hardness of 77±5°. The developer D has an average particle diameter between 6.5 μm and 8.0 μm, and is formed of a styrene-acryl copolymer as a main component thereof. It should be noted that the circumferential speed of the roller is defined as a liner speed on a tangent line at the outer circumference of the roller.

In the embodiment, the developer supplying roller 62 is configured to supply the developer D to the developing roller 61. The developer supplying roller 62 is arranged to abut against the developing roller 61, and is configured to rotate in the same direction as the developing roller 61 (represented with an arrow A4, in the counterclockwise direction in FIGS. 2 and 3(*a*)). The developer supplying roller 62 is formed in a cylindrical shape. Further, the developer supplying roller 62 has an outer diameter of about 15.5 mm, and is configured to rotate at a circumferential speed 0.85 times that of the developing roller 61. The developing roller 61 and the developer supplying roller 62 are arranged such that a distance between the axes of the developing roller 61 and the developer supplying roller 62 becomes 14.7 mm. The configuration of the developer supplying roller 62 will be explained in more detail later.

In the embodiment, the developer supplying roller 62 includes a foamed member having a discrete foam structure and constituting a surface of the developer supplying roller 62. The foamed member is formed of a silicone rubber as a main component thereof. It should be noted that the main component is defined as a component of the foamed member having a content ratio greater than 50 mass %. As shown in FIG. 3(*a*), the developer supplying roller 62 includes a metal shaft 62*a* as a conductive rotational axis and a foamed layer 62*b* as the foamed member formed on an outer circumference of the metal shaft 62*a*. The metal shaft 62*a* has a diameter of, for example, 6 mm.

In the embodiment, the foamed layer 62*b* is formed of an elastomer composition, and has a sponge structure having discrete foams. Further, the foamed layer 62*b* has a configuration described below, so that it is possible to attain functions such as uniform transportation capability of the developer D to the developing roller 61, a function of scraping off the developer D from the developing roller 61 after a mirror image is transferred, and developer charging capability to obtain a uniform print density. It should be noted that materials of the foamed layer 62*b* are not limited to those described below.

In the embodiment, the foamed layer 62*b* is formed of a base member including a silicone rubber as a main component thereof and an ethylene-propylene-dien rubber as a sub component thereof. The base member may contain at least one of other sub component such as polyurethane, a butyl rubber, a poly-isoprene rubber, a poly-butadiene rubber, a styrene-butadiene rubber, an ethylene-propylene rubber, an acryl rubber, and the like.

In the embodiment, the base member further contains silica with sedimentation property, calcium carbonate, and conductive carbon black as fillers. The base member may contain other fillers such as fumed silica; a filler such as reinforcing carbon black; metal powders of nickel, aluminum, copper, and the like; metal oxide such as zinc oxide; barium sulfate; titanium oxide; a conductive filler such as a core material of potassium titanium coated with tin oxide, and the like.

In the embodiment, the base member further contains an azo compound type foaming agent as a forming agent so that the base member has the sponge structure. Instead of the azo compound type foaming agent, the base member may contain at least one of other foaming agents such as a bicarbonic acid salt type, an isocyanate type, a nitrous acid salt type, a hydrazine derivative, an azido compound type, and the like. Further, the base member contains peroxide and a sulfur type cross-linking agent. Instead of peroxide and the sulfur type cross-linking agent, the base member may contain other cross-linking agent such as hydrogen siloxane together with a platinum catalyst, an isocyanate compound, and the like.

Figure 4:
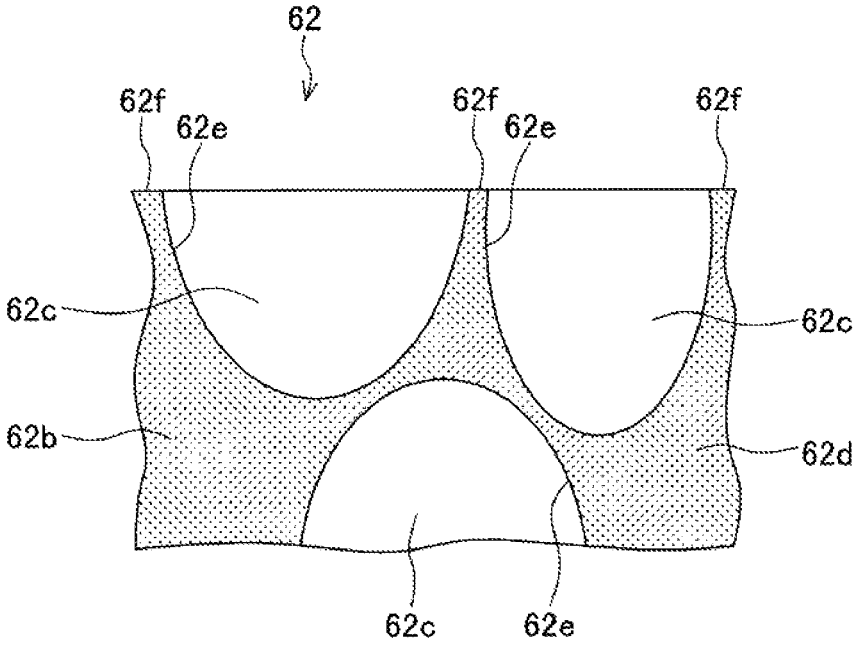
FIG. 4 is a schematic sectional view showing a surface portion of the developer supplying roller of the image forming apparatus according to the first embodiment of the present invention.

FIG. 4 is a schematic sectional view showing a surface portion of the developer supplying roller 62 of the image forming apparatus 1 according to the first embodiment of the present invention. It should be noted that an upper side of FIG. 4 corresponds to a side of the surface of the developer supplying roller 62, and a lower side thereof corresponds to a side of the metal shaft 62*a*.

As shown in FIG. 4, the foamed layer 62*b* includes foam cell walls 62*d* (also referred to as foam films) that divide a plurality of foams 62*c*. The foam cell walls 62*d* include foam cell walls 62*e* facing and dividing the foams 62*c* and outermost surfaces 62*f* not facing the foams 62*c* and constituting the outermost surface of the developer supplying roller 62. It should be noted that the outermost surfaces 62*f* contact with the developing roller 61 as an abutting member.

In the embodiment, in order to maintain good image quality, it is preferred that among the foam cell walls 62*e* which divide the foams 62*c*, a portion of the foam cell walls 62*e* constituting the surface of the developer supplying roller 62 has a ten-point average surface roughness Rz (referred to as a surface roughness Rz) between 45.2 μm and 65.3 μm. The portion of the foam cell walls 62*e* is exposed from the surface of the developer supplying roller 62. More specifically, among the foam cell walls 62*e* exposed from the surface of the developer supplying roller 62, the portion of the foam cell walls 62*e* is defined as a 100 μm square area located from the outermost surfaces 62*f* to a depth of 100 μm (a 100 μm square area located from the outermost surfaces 62*f* toward the axial center by 100 μm).

In the embodiment, the surface roughness Rz is measured according to JIS B0601:1994. More specifically, using a laser microscope VK-8500 (a product of KEYENCE Corporation), a sample is obtained from the portion of the foam cell walls 62*e* under such conditions as a magnification of 1,000 times, a shutter speed of 130, and a measurement pitch of 0.1 μm. Then, the sample is analyzed using a surface roughness analyzing function attached to a shape analysis application as attachment software, so that it is possible to measure the surface roughness Rz of the 100 μm square area.

Further, in the embodiment, in order to maintain good image quality, it is preferred that the developer supplying roller 62 has a stress relaxation ratio between 23.7% and 30.8% upon being compressed. The stress relaxation ratio is measured after 60 seconds from when the developer supplying roller 62 is compressed by 1.5 mm (or a deformation of 32%). More specifically, the developer supplying roller 62 is compressed in a radial direction thereof by 1.5 mm, and is maintained in the compressive state for 60 seconds. Afterward, the stress relaxation ratio is calculated with the following equation (1).

$$\text{Stress relaxation ratio}=(F_{max}-F_{60})/F_{MAX}\times 100 \quad (1)$$

In the equation (1), $F_{max}$ is the maximum load necessary for compressing the developer supplying roller 62 by 1.5 mm (the maximum load at the compression amount of 1.5 mm), that is, the maximum load necessary to applying the compressive deformation of 1.5 mm to the developer supplying roller 62. $F_{60}$ is the load after the developer supplying roller 62 is compressed by 1.5 mm and maintained in the compressive state for 60 seconds.

Further, in the embodiment, in order to maintain good image quality, it is preferred that the developer supplying roller 62 has a compressive modulus coefficient between 38.6 $kN/m^2$ and 55.6 $kN/m^2$. The compressive modulus coefficient is measured when the developer supplying roller 62 is compressed in the radial direction by 1.5 mm (or the deformation of 32%). More specifically, the compressive modulus coefficient is calculated with the following equation (2).

$$\text{Compressive modulus coefficient}=F_{max}/S\times E \quad (2)$$

In the equation (2), similar to the equation (1), $F_{max}$ is the maximum load at the compression amount of 1.5 mm. S is a contact area between the developer supplying roller 62 and a measurement plate (for example, a flat plate) to be pushed against the surface of the developer supplying roller 62 at the compression amount of 1.5 mm. $\epsilon$ is the deformation of the developer supplying roller 62 at the compression amount of 1.5 mm.

Figure 5:
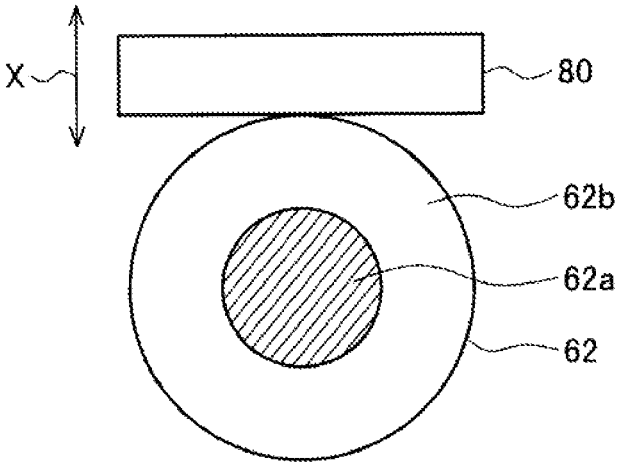
FIG. 5 is a schematic sectional view showing the developer supplying roller of the image forming apparatus in a compressive deformation test according to the first embodiment of the present invention.

In the embodiment, the stress relaxation ratio and the compressive modulus coefficient are specifically measured with a compressive deformation test described below. FIG. 5 is a schematic sectional view showing the developer supplying roller 62 of the image forming apparatus 1 in the compressive deformation test according to the first embodiment of the present invention.

As shown in FIG. 5, in the compressive deformation test, while the load applied to the developer supplying roller 62 is being measured, a measurement plate 80 is pushed against the surface of the foamed layer 62*b* of the developer supplying roller 62 at a measurement speed of 10 mm/min in a state that the metal shaft 62*a* is fixed such that the developer supplying roller 62 does not rotate in the circumferential direction. When the measurement plate 80 is pushed into the foamed layer 62*b* of the developer supplying roller 62 by 1.5 mm, the compressive state is maintained for 60 seconds. Afterward, the measurement plate 80 is lifted at a speed of 10 mm/min. An arrow direction X in FIG. 5 represents the moving direction of the measurement plate 80.

In the compressive deformation test, the measurement plate 80 is a flat plate having a size of 50×50×10 mm, in which a flat surface of 50×50 mm is to abut against the surface of the foamed layer 62*b* of the developer supplying roller 62. Further, the compressive deformation test is conducted using, for example, a multipurpose testing machine 5540 as a single column testing machine (a product of Instron Japan Co., Ltd.).

In the compressive deformation test, the contact area S is measured through calculating a sectional area of the developer supplying roller 62 taken along a plane in parallel to the axial direction of the developer supplying roller 62 and away from the surface of the developer supplying roller 62 by the compression amount, and the sectional area corresponds to the measurement plate 80. The deformation $\epsilon$ is determined through dividing the compression amount by a thickness of one half side of the foamed layer 62*b* of the developer supplying roller 62.

More specifically, the contact area S is determined with the following equation (3), and the deformation $\epsilon$ is determined with the following equation (4).

$$S=2\times\sqrt{\{(R/2)^2-(R/2-d)^2\}}\times L \quad (3)$$

$$\epsilon=d/(R/2-r/2) \quad (4)$$

In the equations (3) and (4), R is the diameter of the developer supplying roller 62; r is the diameter of the metal shaft 62*a*, *d* is the compression amount, and L is a length of the measurement plate 80 in the axial direction of the developer supplying roller 62. For example, when R=15.5 mm, r=6.0 mm, d=1.5 mm, and L=50 mm, the contact area S is determined to be 458 $mm^2$, and the deformation $\epsilon$ is determined to be 0.32 ($S=2\times\sqrt{21}\times50=458$, $\epsilon=1.5/(7.75-3.0)=0.32$ (32%)).

An operation of the image forming apparatus 1 will be explained next with reference to FIGS. 1 and 2. When the control unit of the image forming apparatus 1 receives a print request from, for example, an upper device or an operator (not shown), the control unit controls the drive motor to rotate the pickup roller 22. Accordingly, the pickup roller 22 picks up the recording medium P from the sheet supply cassette 21, so that the transportation rollers 23 and 24 transport the recording medium P to the transfer belt 31.

Further, the control unit controls the image forming portions 10B, 10Y, 10M, and 10C to form the developer images in each color on the photosensitive drums 11 of the image forming portions 10B, 10Y, 10M, and 10C, respectively.

In the embodiment, in the image forming portions 10B, 10Y, 10M, and 10C, the control unit controls the drive motor to transmit the drive force to the photosensitive drums 11, the charging rollers 12, the developing rollers 61, and the developer supplying rollers 62, so that these rollers rotate in the specific directions. When the power source applies the charging bias to the charging rollers 12, the charging rollers 12 are charged with specific electric charges, so that the charging rollers 12 supply the electric charges to the surface of the photosensitive drums 11. After the surfaces of the photosensitive drums 11 are charged, the LED heads 13 irradiate light on the surfaces of the photosensitive drums 11 according to the image information from the control unit, so that the static latent images are formed on the surfaces of the photosensitive drums 11. The developing devices 14 develop the static latent images on the photosensitive drums 11 with the developer D, so that the developer images are formed. At this moment, the developing bias is applied to the metal shafts 61*a* of the developing rollers 61, and the supplying bias is applied to the metal shafts 61*a* of the developer supplying rollers 62.

In the embodiment, after the recording medium P is transported to the transfer belt 31, the control unit controls the transfer belt 31 to transport the recording medium P in the arrow direction A2 in FIG. 1, so that the recording medium P sequentially passes through the image forming portions 10B, 10Y, 10M, and 10C. At this moment, the power source applies the transfer bias to the transfer rollers 34B, 34Y, 34M, and 34C, so that the developer images formed on the photosensitive drums 11 are transferred to the recording medium P on the transfer belt 31. Accordingly, the developer images in each color are sequentially transferred to the recording medium P, so that the developer image in colors is formed.

In the embodiment, after the developer images are transferred, the cleaning blades 15 remove the developer D remaining on the photosensitive drums 11. After the developer image in colors is formed on the recording medium P, the recording medium P is transported from the transfer belt 31 to the fixing device 40. The control unit controls the fixing device 40 to heat up, so that the developer image formed on the recording medium P is fixed to the recording medium P through heat and pressure. After the developer image is fixed to the recording medium P, the discharge rollers 51 and 52 discharge the recording medium P to the discharge portion 53.

An evaluation of the developer supplying roller 62 will be explained next. In the evaluation, 13 samples A to M of the developer supplying roller 62 were prepared, and then were subject to property measurement and a continuous printing test. It should be noted that the property measurement and the continuous printing test were conducted under an environment of a temperature 25±1° C. and humidity of 55±5%.

In the evaluation, the samples A, B, C, D, and E were prepared to have different hardness through adjusting an amount of the foaming agent and an amount of the cross-linking agent. Further, the samples F, G, and H were prepared to have different tensile strengths of the base material through adjusting an extent of cross-linking. Further, the samples I, J, K, L, and M were prepared to have different tensile strengths of the base material through adjusting an amount of the filler. The compositions of the samples A to M are shown in Table 1.

TABLE 1

| Sample | Filler | Foaming agent | Cross-linking agent |
|---|---|---|---|
| A | 1.0 | 1.1 | 0.9 |
| B | 1.0 | 1.1 | 1.0 |
| C | 1.0 | 1.0 | 1.0 |
| D | 1.0 | 1.1 | 1.2 |
| E | 1.0 | 0.9 | 1.2 |
| F | 1.0 | 1.0 | 1.0 |
| G | 1.0 | 1.0 | 1.0 |
| H | 1.0 | 1.0 | 1.0 |
| I | 0.5 | 1.1 | 1.2 |
| J | 0.5 | 1.1 | 1.2 |
| K | 0.5 | 1.1 | 1.2 |
| L | 0.5 | 1.1 | 1.2 |
| M | 0.5 | 1.1 | 1.2 |

In Table 1, the amounts of the filler, the foaming agent, and the cross-linking agent of the sample C are considered as the standard, and are represented with "1". The amounts of the filler, the foaming agent, and the cross-linking agent of the other samples are represented as ratios relative to those of the sample C. For example, the sample A contained the filler, the foaming agent, and the cross-linking agent in the amounts of 1.0 times, 1.1 times, and 0.9 times of those of the sample C, respectively.

In the evaluation, the samples A to M of the developer supplying roller 62 had an outer diameter of 15.5 mm with the metal shaft having a diameter of 6.0 mm. Further, the samples A to M of the developer supplying roller 62 had the discrete foam structure having a cell (foam) diameter between 50 μm and 300 μm and an average cell diameter between 80 μm and 120 μm. The cell diameter was measured with the laser microscope VK-8500 (the product of KEYENCE Corporation).

In the evaluation, the samples A to M of the developer supplying roller 62 contained a conductive agent for imparting conductivity such that a partial resistivity became between $10^6\Omega$ and $10^8\Omega$. The partial resistivity was measured using a metal roller having a width of 5.0 mm and arranged on the foamed layer (the sponge portion) of the samples A to M of the developer supplying roller 62 at six locations with an equal interval along a longitudinal direction thereof. More specifically, the partial resistivity was determined as an average resistivity measured when a specific voltage was applied between the metal shaft and the metal rollers abutting against the sponge portion (the foamed layer 62*b* shown in FIG. 3(*b*)) of the samples A to M of the developer supplying roller 62.

In the evaluation, the properties of the samples A to M of the developer supplying roller 62 were measured. The properties included the surface roughness Rz, the stress relaxation ratio, the compressive modulus coefficient, the Asker hardness, and the tensile strength. Each of the properties was measured as described below.

As described above, the ten-point average surface roughness Rz was measured in the 100 μm square area located from the outermost surfaces constituting the roller surface to the depth of 100 μm using the laser microscope VK-8500 and the shape analysis application (the product of KEYENCE Corporation). The 100 μm square area was selected from the outermost surfaces to the depth of 100 μm because the 100 μm square area exhibited wear to the largest extent when the surfaces of the samples A to M of the developer supplying roller 62 were observed after the continuous printing test.

In the evaluation, the compressive deformation test as described above was conducted using the multipurpose testing machine 5540 as a single column testing machine (a product of Instron Japan Co., Ltd.) and the measurement plate (the flat plate) having a size of 50×50×10 mm, so that the stress relaxation ratio and the compressive modulus coefficient were calculated with the equations (1) and (2). It should be noted that the compressive deformation test was conducted using the samples prepared similar to the samples A to M of the developer supplying roller 62 for the continuous printing test. The contact area S between the measurement plate and the developer supplying roller 62 was 458 $mm^2$, and the deformation $\epsilon$ was 0.32 (32%).

In the continuous printing test, each of the samples A to M of the developer supplying roller 62 was installed in the developing device 14, and the developing device 14 was attached to the image forming apparatus 1, so that the continuous printing test was conducted on the image forming apparatus 1. More specifically, the developing bias was set to be about −130 V, the supplying bias was set to be about −260 V, and the charging bias was set to be about −1,000 V. Then, a specific image for the continuous printing test was printed on 20,000 sheets of the A4 size paper in a lateral transportation mode with the image density (the coverage) of 0.3%. It should be noted that each of the samples A to M of the developer supplying roller 62 was installed in the developing device 14, and the developing device 14 was attached to the image forming portion 10C that formed the specific image in cyan.

In the continuous printing test, during the printing operation, a specific image for print density evaluation and a specific image for after image evaluation were printed every 1,000 sheets, so that the print density and the after image were evaluated.

In the print density evaluation, an image with the image density of 100% (a black solid image) was printed in an entire area of a printable area of the A4 size sheet, so that the print density of the image thus printed was measured. More specifically, the image density was measured at nine points in the image at a leading edge portion, a center portion, and a trailing edge portion thereof in the sheet transportation direction (a point apart from the trailing edge of the image by 20 mm) on both edge portions and a center portion in a direction perpendicular to the sheet transportation direction. The print density was measured using X-Rite 528 (a product of X-Rite Inc.).

In the after image evaluation, the specific image for the after image evaluation was printed, so that the after image evaluation was conducted using the specific image. In order to easily generate the after image phenomenon, when the specific image for the after image evaluation was printed, the supplying bias was reduced from −260 V to −170 V, and the supplying bias was reduced below the developing bias by −40 V.

In general, when the after image phenomenon occurs, an image is formed with contrast opposite to that of another image printed immediately before. The after image phenomenon can be attributed only to the developer supporting member, only to the developer supplying member, or to both the developer supporting member and the developer supplying member. In the evaluation, the after image phenomenon attributed to both the developer supporting member and the developer supplying member was subject to the evaluation.

In many cases, an evaluation of image problems such as the after image phenomenon is performed with a sensory test method. In the evaluation, in order to standardize the after image evaluation, an after image level as an evaluation indicator of the after image evaluation was determined an evaluation method 1 and an evaluation method 2 as described below.

In the evaluation method 1, the print density in an area, where the after image phenomenon occurred, was measured, and the print density in a surrounding area thereof was measured. Then, a difference between the two print densities was obtained as a density difference. In the next step, using a regional chart for determining the after image level, which was defined in advance, the after image level was determined according to a combination of the print density in the surrounding area and the density difference. The after image level was represented with "1" at the lowest and "10" at the highest. The regional chart was defined through collecting data based on the evaluation results previously obtained.

Figure 6:
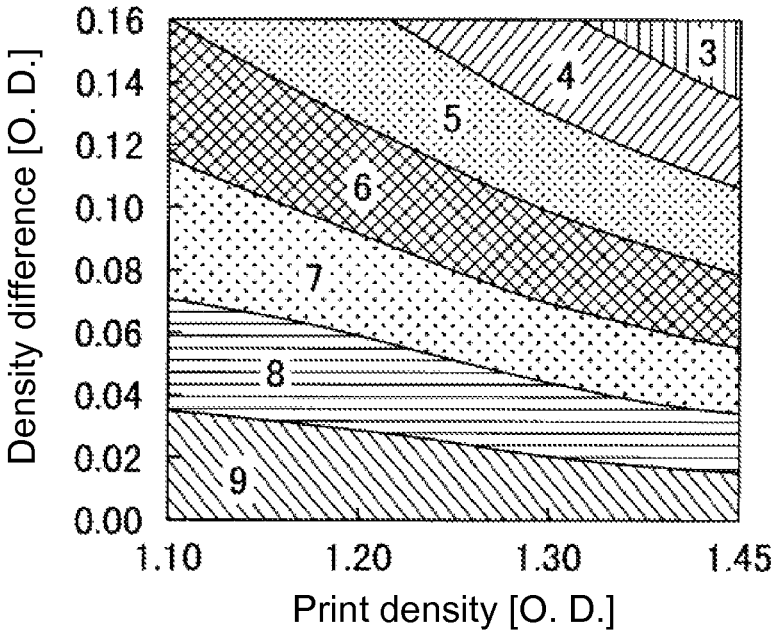
FIG. 6 is a graph showing a relationship between a density difference and a print density of the image forming apparatus in a regional chart for evaluating an after image level according to the first embodiment of the present invention.

FIG. 6 is a graph showing a relationship between the density difference and the print density of the image forming apparatus 1 in the regional chart for evaluating the after image level according to the first embodiment of the present invention. In FIG. 6, the horizontal axis represents the print density of the surrounding area, and the vertical axis represents the density difference.

As shown in FIG. 6, the horizontal axis and the vertical axis define a plane, and the plane is divided with a plurality of regions represented with different hatching patterns. Each of the regions is assigned with a number from "3" to "9". In the evaluation method 1, refer to the regional chart shown in FIG. 6, the after image level is determined as a number assigned to one of the regions corresponding to the combination of the print density in the surrounding area and the density difference. For example, when the print density in the surrounding area was 1.30 and the density difference was 0.09, the after image level is determined as "7". It should be noted that the after image level "10" corresponds to the density difference of zero. Further, the after image levels "1" and "2" are omitted in FIG. 6.

In general, there may be a case where a density step (or a density slope) at a boundary between the area where the after image phenomenon occurs and the surrounding area is clear, and there may be a case where the density step is not so clear. In the evaluation method 2, the density step at the boundary was visually evaluated, and the evaluation result was added to the result in the evaluation method 1. More specifically, in the evaluation method 2, when the boundary was clear, −0.5 was added to the after image level determined with the evaluation method 1. When the boundary was unclear due to smear and the like, +0.5 was added to the after image level determined with the evaluation method 1, thereby determining the final after image level.

In the evaluation, after the continuous printing test, a wear of the developer supplying roller was evaluated. More specifically, the outer diameter of the developer supplying roller was measured before and after the continuous printing test. Then, a difference between the outer diameters of the developer supplying roller before and after the continuous printing test was calculated as a wear amount.

Table 2 shows the results of the property measurement and the evaluation results of the continuous printing test of the samples A to M.

TABLE 2

| Sample | Tensile strength (N) | Hardness | Wear amount (mm) | | Rz (μm) | Stress relaxation rate (%) | Compressive modulus coefficient (kN/m$^2$) |
|---|---|---|---|---|---|---|---|
| A | 4.18 | 48 | 0.19 | poor | 72.7 | 35.0 | 32.3 |
| B | 4.18 | 52 | 0.17 | poor | 69.8 | 34.2 | 42.0 |
| C | 4.18 | 55 | 0.15 | good | 45.2 | 30.2 | 52.1 |
| D | 4.18 | 54 | 0.15 | good | 65.3 | 30.8 | 47.3 |
| E | 4.18 | 62 | 0.12 | good | 41.8 | 22.6 | 62.7 |
| F | 4.78 | 61 | 0.10 | good | 64.0 | 25.2 | 49.5 |
| G | 4.58 | 58 | 0.30 | poor | 72.4 | 32.6 | 47.3 |
| H | 5.42 | 61 | 0.27 | poor | 73.2 | 33.9 | 50.8 |
| I | 3.59 | 48 | 0.15 | good | 67.3 | 38.3 | 33.6 |
| J | 3.59 | 52 | 0.13 | good | 64.6 | 27.0 | 38.6 |
| K | 3.59 | 58 | 0.13 | good | 46.6 | 23.7 | 55.6 |
| L | 4.38 | 55 | 0.13 | good | 51.6 | 24.4 | 48.2 |
| M | 4.65 | 55 | 0.11 | good | 58.6 | 24.2 | 50.9 |

| Sample | Final after image level | | Final print density [O.D.] | | Total performance |
|---|---|---|---|---|---|
| A | 8.0 | fair | 1.19 | poor | fair 1 |
| B | 7.5 | fair | 1.24 | poor | fair 1 |
| C | 7.0 | good | 1.33 | good | good |
| D | 8.0 | good | 1.30 | good | good |
| E | 6.5 | poor | 1.30 | good | fair 2 |
| F | 7.0 | good | 1.31 | good | good |
| G | 5.5 | poor | 1.13 | poor | poor |
| H | 4.5 | poor | 1.20 | poor | poor |
| I | 4.0 | poor | 1.41 | good | fair 2 |
| J | 7.5 | good | 1.42 | good | good |
| K | 7.0 | good | 1.32 | good | good |
| L | 8.5 | good | 1.30 | good | good |
| M | 7.0 | good | 1.31 | good | good |

Table 2 shows the results of the property measurement (the tensile strength, the hardness, the surface roughness Rz, the stress relaxation ratio, the compressive modulus coefficient) of the samples A to M. Further, Table 2 shows the evaluation results (the wear amount, the final after image level, the final print density, the total performance) of the continuous printing test of the samples A to M. It should be noted that the final after image level represented the after image level after the continuous printing test was completed (that is, after 20,000 sheets were printed). Further, it should be noted that the final print density represented a calculated average value of the print densities at nine points measured after the continuous printing test was completed (that is, after 20,000 sheets were printed).

In the evaluation results, when the sample exhibited the final print density greater than 1.3 [O. D.], the result was determined as a sufficient density. When the sample exhibited the final print density less than 1.3 [O. D.], the result was determined as a low density. The evaluation results of the final print density are shown in the column "Final print density" of Table 2 as either "good" or "poor". The "poor" result represents the low density, and the "good" result represents the sufficient density.

Further, in the evaluation results, when the sample exhibited the final print density greater than 1.3 [O. D.], the sample was determined to have good wear durability. When the sample exhibited the final print density less than 1.3 [O.D.], the sample was determined to have poor wear durability. The evaluation results of the wear durability are shown in the column "Wear amount" of Table 2 as either "good" or "poor". The "poor" result represents the poor wear durability, and the "good" result represents the good wear durability.

Further, in the evaluation results, when the sample exhibited the final after image level between 7 and 10, the sample was determined to have good final after image level. When the sample exhibited the final after image level less than 7, the sample was determined to have poor final after image level. The evaluation results of the final after image level are shown in the column "Final after image level" of Table 2 as either "good", "fair", or "poor". The "poor" result represents the poor final after image level, the "fair" result represents the good final after image level but the insufficient print density, and the "good" result represents the good final after image level.

Based on the final print density and the final after image level, total performance was determined. The evaluation results of the total performance are shown in the column "Total performance" of Table 2 as either "good", "fair 1", "fair 2", or "poor". The "poor" result represents the poor final print density and the poor final after image level, the "fair 1" result represents the good final after image level but the insufficient print density, the "fair 2" result represents the good print density but the insufficient final after image level, and the "good" result represents the good final print density and the good final after image level.

According to the evaluation results shown in Table 2, the wear amount of the samples A to E seems to have an inverse proportional relationship relative to the hardness. However, although the samples F to H had the high tensile strength and the high hardness, the samples G and H exhibited the large wear amount, except the sample F. Further, the sample E exhibited the small wear amount, but the low print density of the printed image at the trailing edge portion (refer to Table 3 and FIG. 9 described later).

Figure 7:
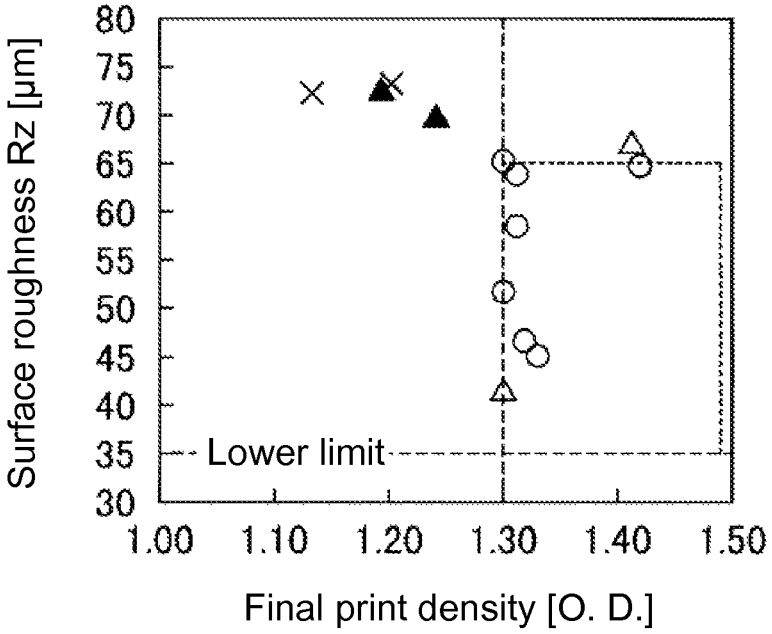
FIG. 7 is a graph showing a relationship between a surface roughness of the developer supplying roller and a final print density of the image forming apparatus according to the first embodiment of the present invention.

FIG. 7 is a graph showing a relationship between the surface roughness Rz of the developer supplying roller 62 and the final print density of the image forming apparatus 1 according to the first embodiment of the present invention. As shown in FIG. 7, the final print density tends to decrease as the surface roughness Rz increases. The final print density was determined to be good (greater than 1.30) when the surface roughness Rz was less than 65.3 μm.

Figure 10:
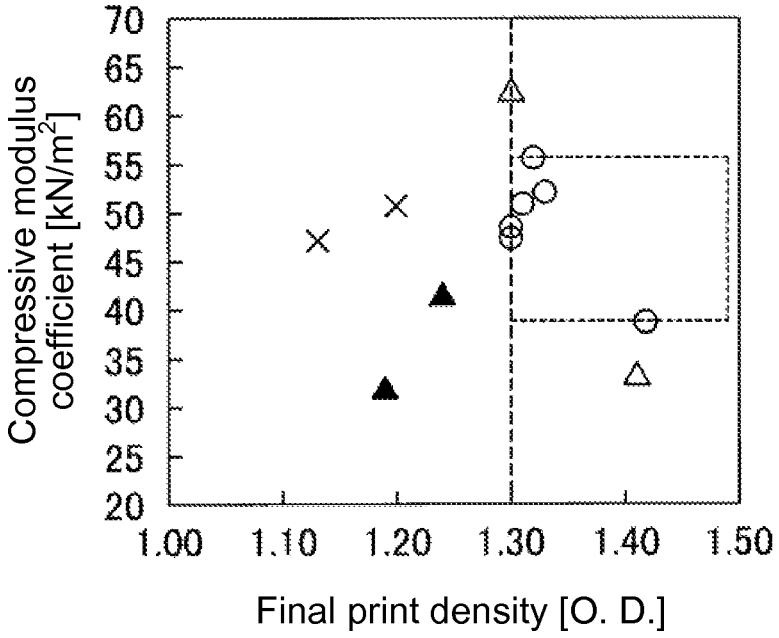
FIG. 10 is a graph showing a relationship between a compressive modulus coefficient of the developer supplying roller and the final print density of the image forming apparatus according to the first embodiment of the present invention.
Figure 11:
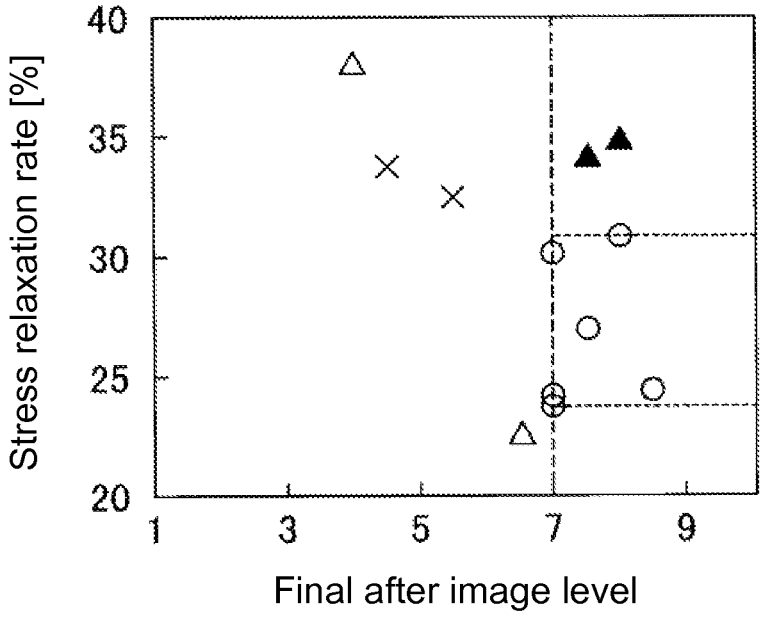
FIG. 11 is a graph showing a relationship between a stress relaxation rate of the developer supplying roller and the final after image level of the image forming apparatus according to the first embodiment of the present invention.

It should be noted that the plots in FIG. 7 indicate the results of the total performance. More specifically, the "good" result is represented with an empty circle, the "fair 1" result is represented with a solid triangle, the "fair 2" result is represented with an empty triangle, and the "poor" result is represented with "X". The plots in FIGS. 8, 10, and 11 are represented as the same as those in FIG. 7.

In general, the surface roughness of the foam cell wall is dependent on an amount of the filler, an amount of the foaming agent, and an amount of the cross-linking agent. The amounts of the foaming agent and the cross-linking agent affect on the thickness of the foam cell wall as well.

Through adjusting the amount of the filler, which is relatively easy to change, when the foam member was prepared with a minimum amount of the filler capable of producing the foamed member, the developer supplying member had the surface roughness Rz of about 35 μm. Accordingly, in the evaluation, about 35 μm was defined as the lower limit of the surface roughness Rz of the foamed member with the discrete foam structure.

Figure 8:
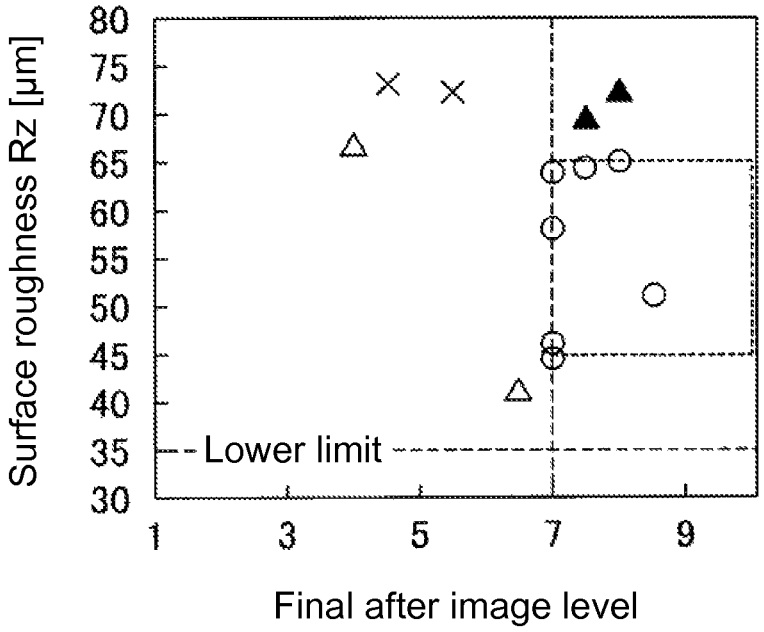
FIG. 8 is a graph showing a relationship between the surface roughness of the developer supplying roller and a final after image level of the image forming apparatus according to the first embodiment of the present invention.

FIG. 8 is a graph showing a relationship between the surface roughness Rz of the developer supplying roller 62 and the final after image level of the image forming apparatus 1 according to the first embodiment of the present invention.

As shown in FIG. 8, the final after image level tends to decrease as the surface roughness Rz increases. When the surface roughness Rz was less than 65.3 μm, it was possible to obtain the final after image level at the satisfactory level. Further, when the surface roughness Rz became very small, the final after image level became small. When the surface roughness Rz was greater than 45.2 μm, it was possible to obtain the final after image level at the satisfactory level.

In the evaluation, it was presumed that the final after image level decreased at the composition having the surface roughness Rz at a small value, which also had the storage modulus coefficient of the foam cell wall at a low level. As a conclusion, when the surface roughness Rz is in the range between 45.2 μm and 65.3 μm, it is possible to obtain the final after image level at the satisfactory level.

Figure 9:
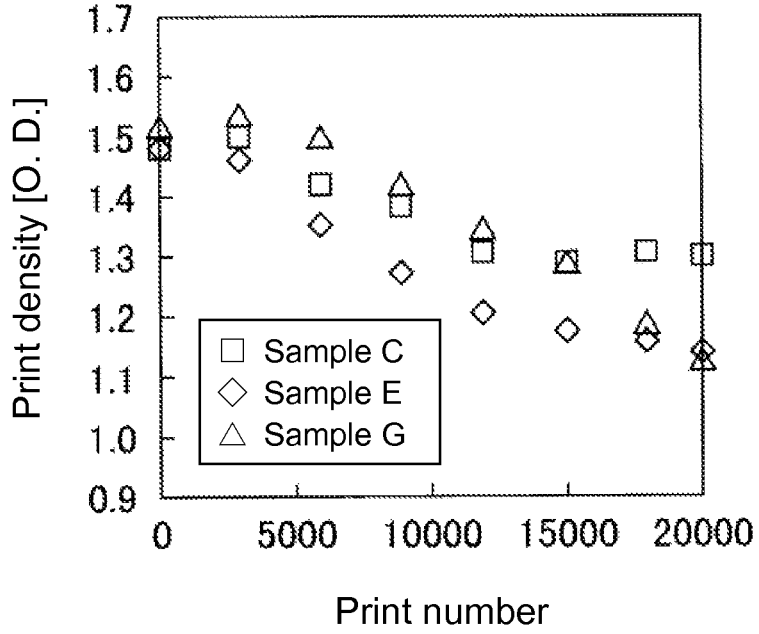
FIG. 9 is a graph showing a relationship between the print density and a print number of the image forming apparatus according to the first embodiment of the present invention.

FIG. 9 is a graph showing a relationship between the print density and the print number of the image forming apparatus 1 using the samples C, E, and G in the continuous printing test according to the first embodiment of the present invention. Further, Table 3 shows the relationship between the print density and the print number of the image forming apparatus using the samples C, E, and G.

TABLE 3

| Print number | Trailing edge density | | |
|---|---|---|---|
| (sheet) | Sample C | Sample E | Sample G |
| 0 | 1.48 | 1.48 | 1.52 |
| 3,000 | 1.50 | 1.46 | 1.54 |
| 6,000 | 1.42 | 1.35 | 1.50 |
| 9,000 | 1.38 | 1.27 | 1.42 |
| 12,000 | 1.30 | 1.20 | 1.34 |
| 15,000 | 1.28 | 1.17 | 1.28 |
| 18,000 | 1.30 | 1.15 | 1.18 |
| 20,000 | 1.29 | 1.13 | 1.12 |

In the evaluation, the sample C was selected as the standard, and the samples E and G were selected for the print density evaluation. The sample E had the tensile strength identical to that of the sample C, the hardness similar to that of the sample C, and the stress relaxation rate smaller than that of the sample C. The sample G had the tensile strength greater than that of the sample C, the hardness similar to that of the sample C, and the surface roughness Rz greater than that of the sample C.

In the evaluation, the print densities shown in Table 3 and FIG. 9 were a calculated average value of the print densities at three points at the trailing edge portion of the print image used for the print density evaluation in the sheet transportation direction. Further, in FIG. 9, an empty square represents the result of the sample C, an empty diamond represents the result of the sample E, and an empty triangle represents the result of the sample G.

As shown in Table 3 and FIG. 9, the print density tends to decrease as the print number increases with respect to all samples. Further, the print density of the sample E started decreasing earlier than that of the sample G that had the large wear amount.

In general, in the electro-photography process, when the developer supplying member abuts against the developer supporting member, it is presumed that developer is supplied and scraped off through a physical chemistry effect and the difference in the biases applied to the developer supplying member and the developer supporting member.

In the embodiment shown in FIGS. 3(*a*) and 3(*b*), it is presumed that developer is supplied at a downstream side portion 62*g* of the foam cell wall 62*d* in the rotational direction of the developer supplying roller 62, and developer is scraped off at an upstream side portion 62*h* of the foam cell wall 62*d* in the rotational direction of the developer supplying roller 62.

In general, when the developer supplying member abuts against the developer supporting member, it is presumed that the abutting force applied to the developer supplying member having the discrete foam structure is concentrated on the foam call wall having a relatively small surface area. Accordingly, the developer supplying member, which has a hardness smaller than that of the developer supporting member, tends to wear more easily through friction. When the developer supplying member wears out, the foam cell wall, which is deformed in the direction opposite to the rotational direction due to the abutting force, tends to stand up. Accordingly, it is presumed that developer tends to be scraped off more easily, thereby making it difficult to obtain the sufficient print density.

In general, it is presumed that the components of the developer supplying member have the following effects on the wear mechanism of the developer supplying member. Firstly, for example, the filler to be added has a relaxation time dependence and flow ability different from those of the base material. Further, the filler has a surface activity different from those of the base material, thereby lowering compatibility thereof relative to the base material. As a result, an interface of the filler tends to have a weak bonding force, so that a debonding point is generated rather easily through an external stress.

In general, in the electro-photography process, the developer supplying member is subject to a cyclic compression-relaxation process. Accordingly, the debonding point generated through the process described above promotes a growth of the interface through fatigue breakdown, so that the foam cell wall wears and is finely debonded. As a result, the wear amount tends to increase as the amount of the filler exposed near the surface of the base material increases.

Secondary, with respect to the cross-linking agent agent, when an extent of the cross-linking is increased, the foam cells tend to expand more inconsistently during the foaming process, thereby increasing the surface roughness of the base material. Further, the cross-linking process generates hysteresis, thereby increasing the amount of the filler exposed from the base material. As a result, the number of the stress concentration points is increased, thereby facilitating wear.

Thirdly, with respect to the foaming agent, when an amount of the foaming agent is increased, a size of a void (a space) in the foam cells tends to increase. As a result, the filler has a tendency to protrude from the surface of the foam cell wall, thereby facilitating wear.

On the other hand, when an amount of the foaming agent is decreased, the amount of the filler exposed from the surface of the foam cell wall decreases, thereby decreasing the wearing points. However, the thickness of the foam cell (the foam cell film thickness) tends to increase. As a result, the debonding points are generated more inside the foam cell walls. Accordingly, as a result of the fatigue breakdown, the foam cell walls tend to lose modulus. Consequently, developer is scraped off less efficiently, thereby decreasing the after image level.

As described above, as summary, it is possible to control the wear amount and the modulus decline of the developer supplying member through controlling the debonding points protruding from the surface of the developer supplying member. Accordingly, it is possible to prevent the function of the developer supplying member from deteriorating associated with the usage thereof.

More specifically, the number (the amount) of the debonding points has a positive proportional relationship relative to the surface roughness Rz. Accordingly, through controlling the surface roughness Rz, it is possible to prevent the function of the developer supplying member from deteriorating associated with the usage thereof. In turn, it is possible to prevent the image quality from lowering due to the functional deterioration of the developer supplying member.

FIG. 10 is a graph showing a relationship between the compressive modulus coefficient of the developer supplying roller 62 and the final print density of the image forming apparatus 1 according to the first embodiment of the present invention. FIG. 11 is a graph showing a relationship between the stress relaxation rate of the developer supplying roller 62 and the final after image level of the image forming apparatus 1 according to the first embodiment of the present invention As described above, in the electro-photographic process, the developer supplying member is configured to supply and scrape off developer through the cyclic process of the compression and the relaxation relative to the developer supporting member (the abutting member). Therefore, it is considered that the physical properties of the developer supplying member (and the developer supporting member) have an influence on the image quality.

In the embodiment shown in FIGS. 3(*a*) and 3(*b*), after the developer supplying roller 62 supplies developer to the developing roller 61, the foam cell walls of the developer supplying roller 62 are configured to regulate the layer thickness of developer. Accordingly, it is presumed that the amount of developer supplied from the developer supplying roller 62 to the developing roller 61 is correlated to the compressive modulus coefficient of the developer supplying roller 62 and the like. For this reason, the graph shown in FIG. 10 illustrates the relationship between the compressive modulus coefficient of the developer supplying roller 62 and the final print density of the image forming apparatus.

Further, the modulus of the developer supplying member has a dominant influence on the ability of the developer supplying member for scraping off developer from the developer supporting member. However, unless the stress relaxation is adequately adjusted, it is difficult to scrape off developer with a sufficient force. For this reason, the graph shown in FIG. 11 illustrates the relationship between the stress relaxation rate of the developer supplying roller 62 and the final after image level of the image forming apparatus 1.

As shown in FIGS. 10 and 11, in order to achieve the good print density and the good after image level, it is preferred that the compressive modulus coefficient of the developer supplying roller 62 is within a range between 38.6 $kN/m^2$ and 55.6 $kN/m^2$, and the stress relaxation rate of the developer supplying roller 62 is within a range between 23.7% and 30.8%.

As described above, there is the correlation between the physical properties of the developer supplying member such as the compressive modulus coefficient and the stress relaxation rate, and the image quality such as the final print density and the final after image level. In consideration of the correlation, it is presumed that a storage modulus component and a loss modulus component are mutually related in the supply process and the scarping off process of developer of the developer supplying member. Here, the storage modulus component affects the hardness and the compressive modulus coefficient, and the loss modulus component affects the stress relaxation rate and the deformation.

As shown in FIG. 10, even when the developer supplying member had the compressive modulus coefficient within the range between 38.6 $kN/m^2$ and 55.6 $kN/m^2$, the samples B, G, and H exhibited the poor result in the final print density (two X points and one solid triangle point). It is presumed that, this is because, even the compressive modulus coefficient was within the preferable range, the samples B, G, and H did not have the surface roughness Rz within the preferable range.

Therefore, the samples B, G, and H exhibited excessive wear, thereby deteriorating the image quality.

As described above, in the embodiment, the developer supplying roller 62 includes the foamed member having the discrete foam structure and constituting the surface of the developer supplying roller 62. The foamed member is formed of a silicone rubber as the main component thereof. Further, among the foam cell walls 62*e* which divide the foams 62*c* of the foamed member, the portion of the foam cell walls 62*e* constituting the surface of the developer supplying roller 62 has the ten-point average surface roughness Rz (the surface roughness Rz) between 45.2 μm and 65.3 μm. Accordingly, it is possible to maintain the good image quality for an extended period of time.

More specifically, in the embodiment, it is possible to obtain the foam structure with the good durability through adjusting the surface roughness Rz of the developer supplying roller 62. That is, the surface roughness Rz of the developer supplying roller 62 is controlled to be within the above-mentioned range. Accordingly, it is possible to reduce wear of the foamed member caused by the friction between the developer supplying roller 62 and the developing roller 61 during the electro-photography process. Further, it is possible to prevent the modulus of the foam cell walls 62*e* from deteriorating due to fatigue breakdown. As a result, it is possible to maintain the supplying ability and the scraping off ability of developer of the developer supplying roller 62, thereby making it possible to maintain the good print density and the good after image level for an extended period of time.

Further, in the embodiment, it is preferred that the developer supplying roller 62 has the stress relaxation ratio between 23.7% and 30.8% upon being compressed. Accordingly, it is possible to maintain the good image quality for an extended period of time.

More specifically, in the embodiment, through controlling the stress relaxation ratio of the developer supplying roller 62 within the above-mentioned range, it is possible to maintain the supplying ability and the scraping off ability of developer of the developer supplying roller 62, thereby making it possible to maintain the good print density and the good after image level for an extended period of time.

It should be noted that the present invention is not limited to the embodiment described above, and can be modified within the scope of the present invention.

More specifically, the configurations of the developer supplying roller 62 and the developing roller 61 are not limited to those in the embodiment. For example, as long as the developing roller 61 has the outer diameter between 15 and 21 mm and the developer supplying roller 62 has the outer diameter between 15 and 16 mm, it would be possible to obtain the similar effect. Further, in the developing device 14, the ratio of the circumferential speeds of the developer supplying roller 62 and the developing roller 61 is not limited to 0.85 as described above.

Further, in the above description, the continuous printing test was conducted using the image forming portion 10C in the color of cyan. It should be noted that the continuous printing test using the image forming portion in other color will exhibit the similar results.

Second Embodiment

A second embodiment of the present invention will be explained next. In the first embodiment, the image forming apparatus 1 shown in FIG. 1 is explained, and the present invention is not limited thereto. The present invention is widely applicable to other image forming apparatus using the electro-photography method.

Figure 12:
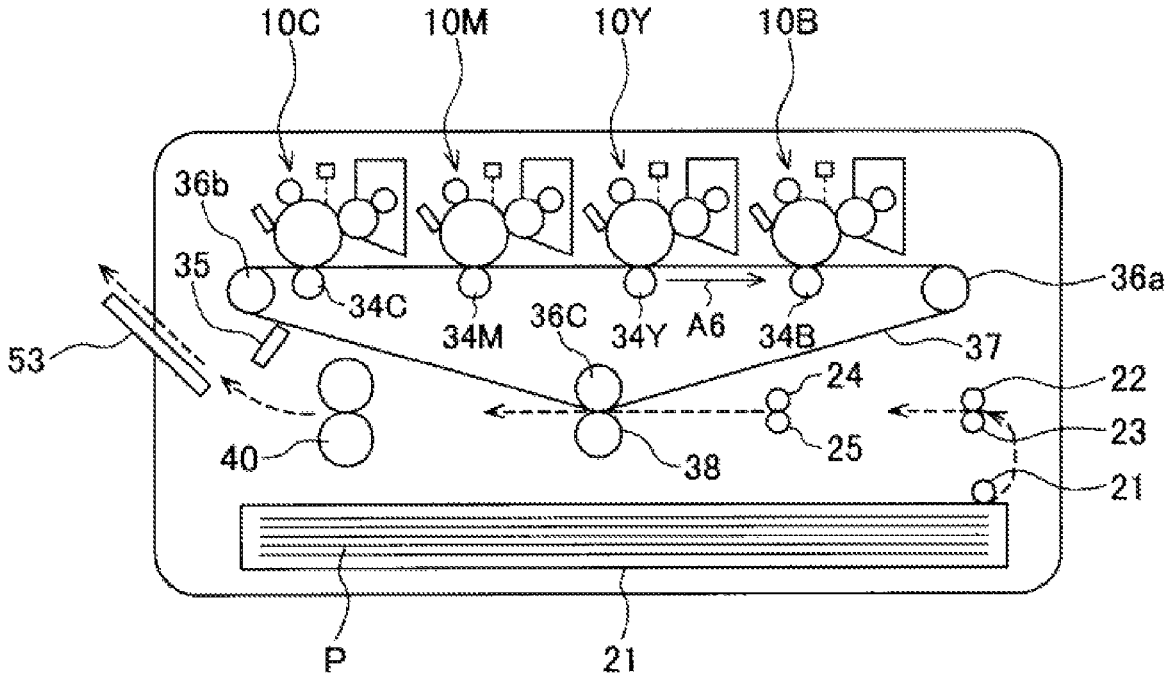
FIG. 12 is a schematic view showing a configuration of an image forming apparatus of an intermediate transfer belt type according to a second embodiment of the present invention.

In the second embodiment, the present invention is applied to an image forming apparatus as shown in FIG. 12 using a method in which an intermediate transfer belt is provided for directly supporting developer. FIG. 12 is a schematic view showing a configuration of the image forming apparatus of the intermediate transfer belt type according to the second embodiment of the present invention. In FIG. 12, components of the image forming apparatus similar to those in FIG. 1 are designated with the same reference numerals.

As shown in FIG. 12, the image forming apparatus includes the image forming portions 10B, 10Y, 10M, and 10C for forming the developer images, and the transfer rollers 34B, 34Y, 34M, and 34C are configured to sequentially and primarily transfer the developer images to an intermediate transfer belt 37. The intermediate transfer belt 37 is extended with three rollers 36*a*, 36*b*, and 36*c*, so that the intermediate transfer belt 37 moves in an arrow direction A6 in FIG. 12.

In the embodiment, the pickup roller 21 and the transportation rollers 22, 23, 24, and 25 are arranged to transport the recording medium P from the sheet cassette 21. After the developer images are transferred to the intermediate transfer belt 37, a transfer roller 38 is provided for secondarily transferring the developer images to the recording medium P. After the developer images are transferred to the recording medium P, the fixing device 40 is configured to apply the fixing process on the recording medium P. Afterward, the recording medium P is discharged to the discharge portion 53. Further, the cleaning blade 35 is configured to remove developer remaining on the intermediate transfer belt 37.

It should be noted that the present invention is applicable to a monochrome image forming apparatus that does not use the intermediate transfer belt. Further, the present invention is applicable to a multi-color image forming apparatus using developer in a plurality of colors in addition to the four colors described above (for example, more than five colors).

The disclosure of Japanese Patent Application No. 2012-165544, filed on Jul. 26, 2012, is incorporated in the application.

While the invention has been explained with reference to the specific embodiments of the invention, the explanation is illustrative and the invention is limited only by the appended claims.

What is claimed is:

1. A developer supplying member for supplying developer to a developer supporting member, comprising:

a foamed member having a discrete foam cell structure and being formed of a silicone rubber as a main component thereof, wherein said foamed member constitutes a surface of the developer supplying member, said foamed member includes a foam cell wall dividing foam cells thereof and being exposed on the surface of the developer supplying member, and said foam cell wall has a ten-point average surface roughness Rz between 45.2 μm and 65.3 μm.

2. The developing device according to claim 1, wherein said foamed member has a stress relaxation ratio between 23.7% and 30.8% upon being compressed.

3. A developing device, comprising:

the developer supporting member for developing a static latent image on an image supporting member with developer; and the developer supplying member according to claim 1.

4. An image forming apparatus, comprising:

the image supporting member; and the developing device according to claim 3.

5. A developer supplying member for supplying developer to a developer supporting member, comprising:

a foamed member having a discrete foam cell structure and being formed of a silicone rubber as a main component thereof, wherein said foamed member constitutes a surface of the developer supplying member, and said foamed member has a stress relaxation ratio between 23.7% and 30.8% upon being compressed.

6. A developing device, comprising:

the developer supporting member for developing a static latent image on an image supporting member with developer; and the developer supplying member according to claim 5.

7. An image forming apparatus, comprising:

the image supporting member; and the developing device according to claim 6.

* * * * *